US012510329B2

(12) United States Patent
Paulson

(10) Patent No.: US 12,510,329 B2
(45) Date of Patent: Dec. 30, 2025

(54) ROTOR HOUSING FOR MINIGUN

(71) Applicant: Kristopher Lee Paulson, Hendersonville, TN (US)

(72) Inventor: Kristopher Lee Paulson, Hendersonville, TN (US)

(73) Assignee: CHD Holdings, LLC, Nashville, TN (US)

( * ) Notice: Subject to any disclaimer, the term of this patent is extended or adjusted under 35 U.S.C. 154(b) by 0 days.

(21) Appl. No.: 18/592,199

(22) Filed: Feb. 29, 2024

(65) Prior Publication Data

US 2024/0393081 A1 Nov. 28, 2024

Related U.S. Application Data

(63) Continuation of application No. 17/743,193, filed on May 12, 2022, now Pat. No. 11,976,900.

(60) Provisional application No. 63/300,172, filed on Jan. 17, 2022, provisional application No. 63/187,904, filed on May 12, 2021.

(51) Int. Cl.
*F41F 1/10* (2006.01)
*F41A 9/36* (2006.01)

(52) U.S. Cl.
CPC . *F41F 1/10* (2013.01); *F41A 9/36* (2013.01)

(58) Field of Classification Search
None
See application file for complete search history.

(56) References Cited

U.S. PATENT DOCUMENTS 2,959,106 A * 11/1960 O'Brien ..... F41A 9/36 89/33.03
3,380,342 A * 4/1968 Chiabrandy ..... F41A 9/36 89/137
3,431,817 A * 3/1969 Walkup ..... F41A 17/14 89/33.03
3,611,866 A * 10/1971 Jacolucci ..... F41F 1/10 89/185
4,344,350 A * 8/1982 Golden ..... F41A 9/51 198/594

(Continued)

OTHER PUBLICATIONS

Royal Range USA. How a M134 Minigun works, Full Breakdown!. <https://www.youtube.com/watch?v=7CkqaaVTufw>. Dec. 18, 2017. (Year: 2017).*

*Primary Examiner* — Gabriel J. Klein
(74) *Attorney, Agent, or Firm* — Eric B. Fugett; Mark A. Pitchford; Pitchford Fugett, PLLC

(57) ABSTRACT

An assembly for quickly attaching and detaching the guide bar to and from the rotor housing of a minigun is provided. The assembly comprises a guide bar and a rotor housing. The guide bar includes a front end having a pinhole extending through the front end and a rear end having a locking cam. The rotor housing includes a recessed channel configured to receive the locking cam and a spring-loaded lock pin assembly configured to secure the front end of the guide bar. The guide bar is secured to the rotor housing when the locking cam is inserted into the recessed channel and the spring-loaded lock pin assembly secures the front end of the guide bar. The assembly allows the guide bar to quickly be attached and detached from the rotor housing without the need for tools. The rotor housing may be designed without a yoke to reduce weight.

2 Claims, 11 Drawing Sheets

(56) References Cited

U.S. PATENT DOCUMENTS

| | | | | |
|---|---|---|---|---|
| 6,443,044 | B1 * | 9/2002 | Dillon | F41A 9/36 89/12 |
| 2005/0115393 | A1 * | 6/2005 | Dillon | F41A 17/00 89/12 |
| 2011/0120292 | A1 * | 5/2011 | Garwood | F41A 9/36 89/33.25 |
| 2014/0202057 | A1 * | 7/2014 | Witchel | F41A 25/00 42/1.06 |
| 2016/0265872 | A1 * | 9/2016 | Tarazi | F41A 9/65 |
| 2022/0364825 | A1 * | 11/2022 | Paulson | F41F 1/10 |

* cited by examiner

ROTOR HOUSING FOR MINIGUN

FIELD OF THE DISCLOSURE

The present disclosure relates generally to firearms, and more particularly to a rotor housing having a quick attach guide bar and to a yokeless rotor housing for a multi-barrel rotary firearm, such as a minigun.

BACKGROUND

The modern minigun, or M134 Minigun, is a machine gun which fires projectiles in an automatic fashion. The M134 Minigun is a six-barrel rotary machine gun with a high rate of fire and features a Gatling-style rotating barrel assembly rotated by an electric motor that is powered by an aircraft, ground vehicle, external battery pack or the like. Ammunition belts are used to feed ammunition into the M134 Minigun to allow for high rates of fire.

A minigun has a centrally located rotor for rotating the barrels of the minigun. The rotor has a plurality of bolts, a plurality of bolt tracks, a central axis, a drive gear, and a clutch gear. Typically, the rotor has six bolts and six bolt tracks. The bolts are for receiving, firing, and ejecting ammunition. The bolts and bolt tracks are arranged radially around a central axis of the rotor. Each bolt and bolt track extends longitudinally along the rotor parallel to the central axis. Each bolt has an interior face that faces the central axis of the rotor and an exterior face that faces away from the rotor central axis. Each bolt also has a cam disposed on the exterior face. The bolts are disposed within the bolt tracks. The bolt tracks guide the movement of the bolts forward and rearward. The rotor drive gear is disposed at a forward end of the rotor. The rotation of the drive gear rotates the rotor. The clutch gear is disposed at the rear of the rotor. The clutch gear mates to a gear on the feeder delinker, discussed below.

The rotor is situated within a rotor housing, commonly called the "housing." The housing has an elliptical cam track that is angled diagonally between the front and rear of the housing. The cam on each bolt is disposed within the cam track. The rotor rotates the cams around the elliptical cam track. The diagonal orientation of the cam path translates the rotational movement of the cams into longitudinal movement. As the cams move longitudinally, the cams move the bolts forward and rearward within the bolt tracks. During operation, the bolts receive a round of ammunition as they move forward, fire the round of ammunition at their most forward point, and eject the spent casing as they move rearward.

The minigun also has a feeder delinker for delinking the rounds of ammunition from the ammunition belt and feeding the ammunition into the housing. During firing, an ammunition belt is fed to the feeder delinker. The rounds of ammunitions in the ammunition belt are connected via links. The feeder delinker first removes the rounds from the links. The feeder delinker then passes the ammunition into the housing where they are received by the bolts on the rotor.

A guide bar is secured on the housing for properly aligning the rounds of ammunition as they pass from the feeder delinker into the housing and onto the bolts. On conventional miniguns, the guide bar is conventionally attached to the housing using a roll pin and a bolt. The roll pin attaches the front of the guide bar to the housing near a forward end of the housing. The roll pin acts as an axle that allows the guide bar to rotate toward and away from the housing. The bolt secures the rear end of the guide bar to the housing when the guide bar is rotated toward the housing.

To remove the legacy guide bar, the operator must currently use a socket and wrench to remove the bolt securing the rear end of the guide bar to the housing. The operator must then try to rotate the guide bar out of the housing and away from the rotor. Obstructions within the housing may prevent the guide bar from rotating out of the housing. The operator may also find it difficult to rotate the guide bar out of the housing due to tight tolerances and little working space around the guide bar. After the guide bar is rotated out of the housing, the operator may also need to use a punch and hammer to remove the roll pin that attaches the front of the guide bar to the housing depending on the type of malfunction and fit of the roll pin. The guide bar can then be pulled straight out from the rotor and housing and clear of all other obstructions inside the housing.

The current design and confined spaces on the M134 Minigun platform create issues when correcting malfunctions and conducting maintenance. In the field, an operator may need to quickly attach and detach the guide bar to and from the housing to correct malfunctions such as an ammunition jam. The need to use tools to remove and reinstall the guide bar on the housing hinders the operator from making quick field repairs. It also requires taking additional tools into the field, which increases the weight of materials that need to be transported. Despite these shortcomings, no attempts have been made to alter or adjust the design of the guide bar to allow for quick removal and reinstallation of the guide bar without the need for tools.

Additionally, the current M134 Minigun requires a yoke to be attached to the front of the housing. The yoke is a large block attached to the housing and having a mount for connecting to a platform, mounting stand, or other apparatus for supporting the minigun in the firing position. The yoke also may have one or more flat surfaces for mounting accessory devices to the gun, such as a sight. The yoke is typically made of solid metal and can weigh between 7-20 pounds. Despite these shortcomings, no attempts have been made to alter the design of the minigun by eliminating or reducing the weight of the yoke.

Unnecessary weight, whether it be from additional tools needed to maintain and repair the minigun or from the yoke, is undesirable in many settings in which the M134 Minigun is used. For example, M134 Miniguns are often mounted on planes, helicopters, and ground vehicles. Additional weight slows down and reduces the range of the vehicle, which can have deadly consequences during a military operation.

Accordingly, there remains a need in the art for a minigun housing having a quick attach guide bar that can be easily secured and removed without tools to allow for quick repair and maintenance of the minigun in the field. There also remains a need in the art for a yokeless minigun design to reduce the weight of the minigun.

SUMMARY

In some respects, the invention is directed to an assembly for attaching and detaching a guide bar to a minigun, having a rotor housing having a recessed channel; a guide bar having a front end, a rear end, and a locking cam disposed on the rear end and configured to insert into the recessed channel; and a spring-loaded lock pin assembly configured to releasably fasten the guide bar front end to the rotor housing, wherein the guide bar is secured to the rotor housing when the locking cam is disposed in the recessed channel and the lock pin assembly fastens the guide bar front end to the rotor housing.

In other respects, the present disclosure is directed to a guide bar for attaching and detaching to a minigun rotor housing having a lock pin and a recessed channel, comprising a front end having a pinhole and a rear end having a locking cam extending laterally from the rear end.

In other respects, the present disclosure is directed to a yokeless mounting assembly for securing a minigun to a mount, having a rotor housing having a mounting pad comprising a flat surface and a mounting plate secured on the flat surface of the mounting pad, the mounting plate comprising a connector, wherein the connector is configured to interface with the mount.

BRIEF DESCRIPTION OF THE DRAWINGS

Further features and advantages can be ascertained from the following detailed description that is provided in connection with the drawings described below:

In FIG. 1, a guide bar is secured to the rotor housing.

In FIG. 2, the guide bar is removed from the rotor housing.

In FIG. 3, a lock pin assembly is installed on the rotor housing.

In FIG. 4, the guide bar is detached from the rotor housing.

In FIG. 5, the guide bar is partially secured on the rotor housing.

In FIG. 6, the guide bar is fully secured to the rotor housing.

In FIG. 11, a mounting plate is secured to the rotor housing.

In FIG. 12, the mounting plate is removed from the rotor housing.

In FIG. 13, the mounting plate is removed from the rotor housing.

In FIG. 14, the mounting plate is secured to the rotor housing.

DETAILED DESCRIPTION

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

Spatially relative terms, such as "under," "below," "lower," "over," "upper," and the like, may be used herein for ease of description to describe one element or feature's relationship to another when the apparatus is right side up as shown in the accompanying drawings.

The terms "first," "second," "third," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

The present disclosure provides an improved guide bar for an M134 Minigun. The guide bar of the present disclosure advantageously provides for quick attachment and removal of the guide bar from the housing of the minigun. In addition, the guide bar of the present disclosure can be removed from the housing of the minigun by an operator without the need for tools unlike the legacy guide bar currently used on miniguns. This allows for an operator to quickly repair and conduct maintenance on the minigun in the field without carrying the tools into the field, which add additional weight to the pack of the operator.

Figure 1:
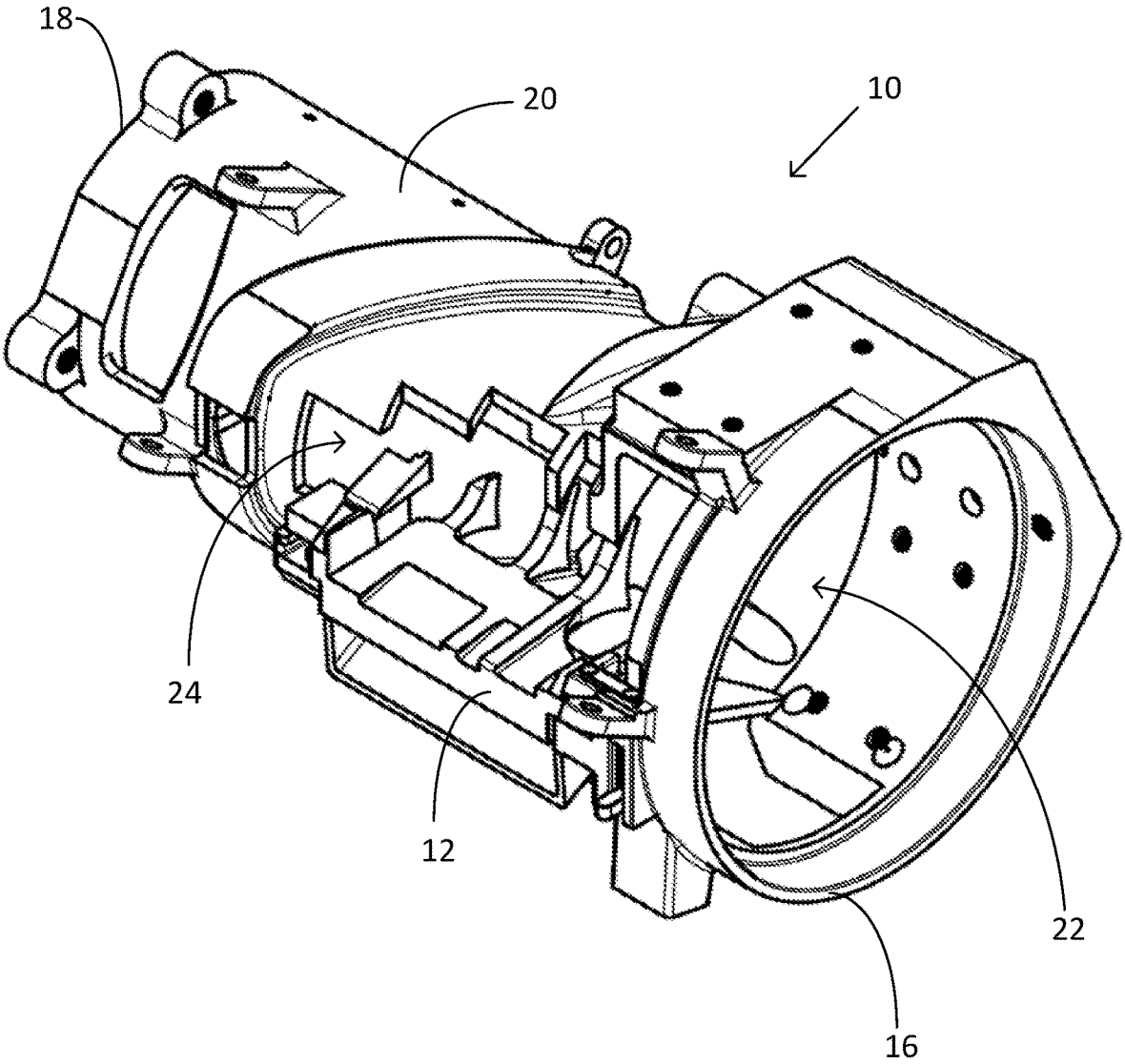
FIG. 1 is a bottom, side perspective view of a rotor housing of a minigun according to an exemplary embodiment of the present disclosure.

Referring to FIG. 1, a rotor housing 10 having a guide bar 12 of an exemplary embodiment of a multi-barrel rotary firearm is shown. In FIG. 1, a rotor 14 is removed from the rotor housing 10. The rotor housing 10 of FIG. 1 is intended for operation in an M134 Minigun. As illustrated in FIG. 1, the rotor housing 10 includes a front 16, a rear 18, an exterior 20, and an open interior 22 for receiving the rotor 14.

As shown in FIG. 1, the rotor housing 10 may further comprise an ammunition port 24 to allow ammunition to be fed to the rotor 14 in the rotor housing 10 from an attached feeder delinker (not shown) and to allow spent ammunition casings to be removed from the rotor housing 10. The ammunition port 24 may extend through the rotor housing 10 from the exterior 20 to the open interior 22 of the rotor housing 10. The ammunition port 24 may comprise a front end 26 and a rear end 28.

Figure 2:
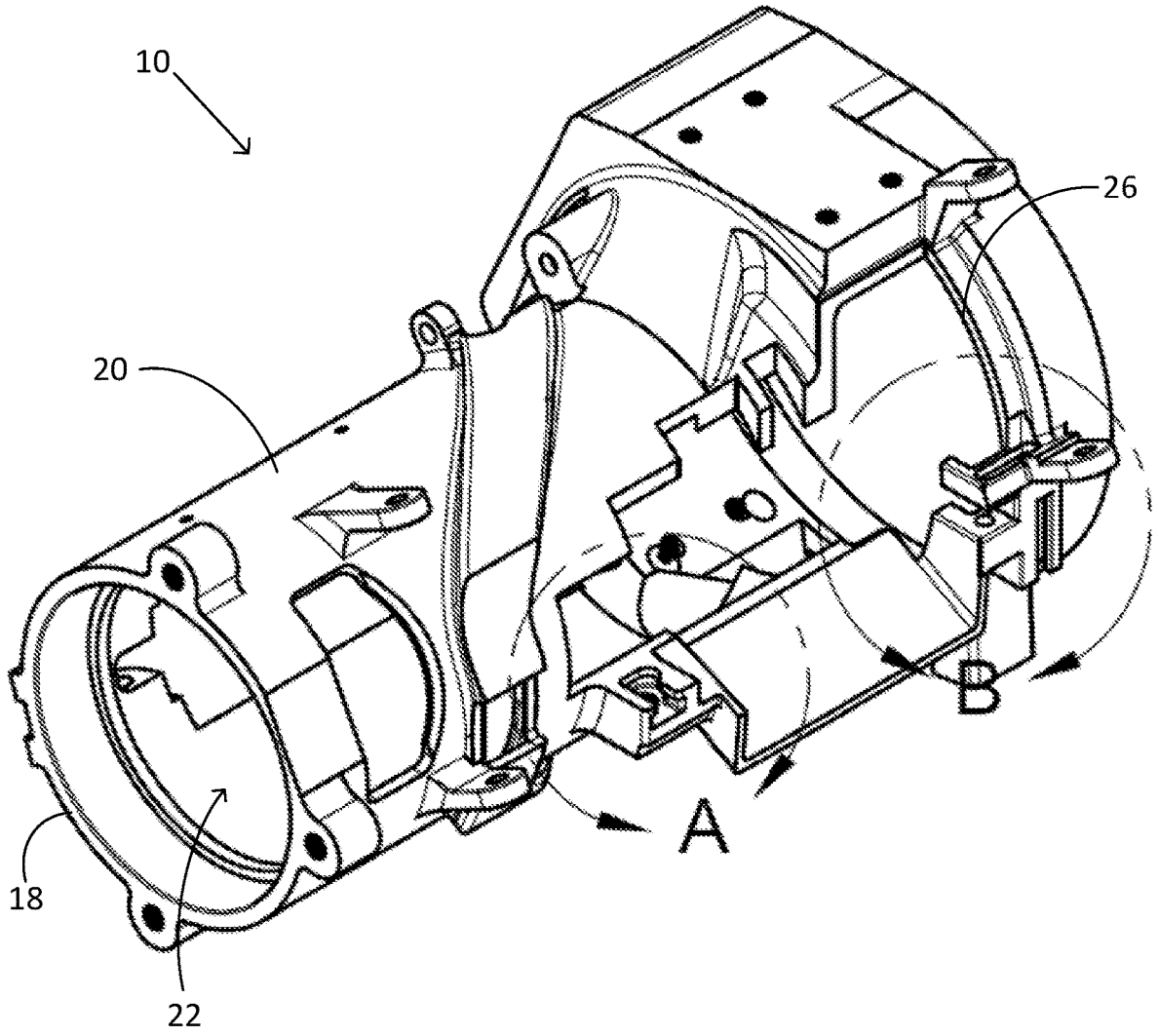
FIG. 2 is another bottom, side perspective view of the rotor housing of FIG. 1.
Figure 2A:
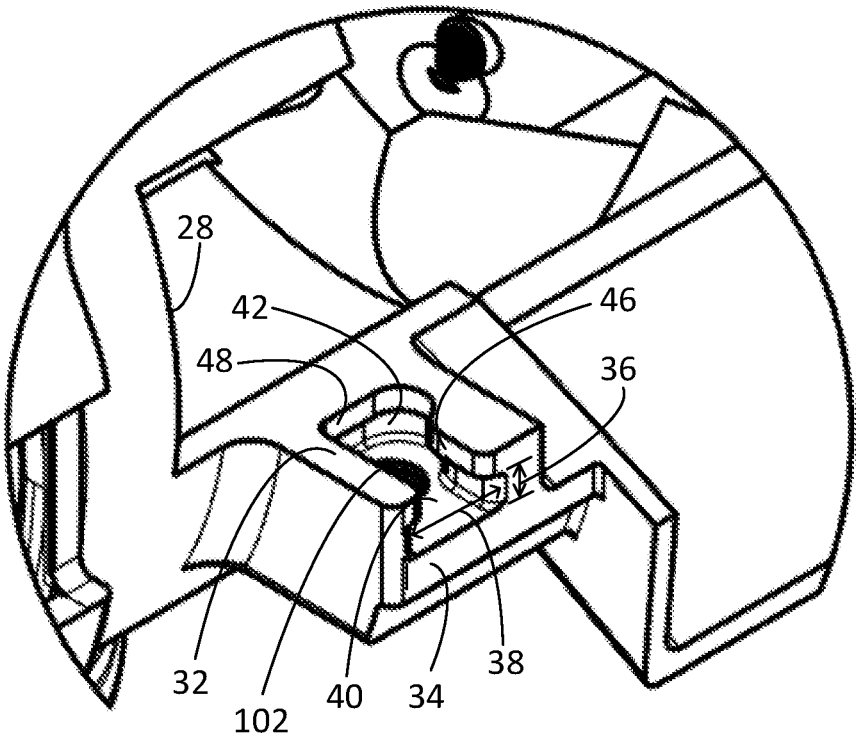
FIG. 2A is enlarged view of a portion of the rotor housing shown in Circle A of FIG. 2.

Referring to FIGS. 2-2A, the rotor housing 10 may comprise a recessed channel 30 adjacent to the rear end 28 of the ammunition port 24 for receiving and securing a guide bar 12, discussed in more detail below. The recessed channel 30 may comprise a front wall 32 and a rear wall 34 bounding the recessed channel 30, a width 36 extending from the front wall 32 to the rear wall 34, and a length 38 extending perpendicular to the width 36. The recessed channel 30 may be in the shape of an "L." The recessed channel 30 may also comprise a vertical portion 40 corresponding to the vertical part of the "L," and a horizontal portion 42 corresponding to the horizontal part of the "L." The horizontal portion 42 may extend forwardly of the vertical portion 40 to form the "L." In some embodiments, the horizontal portion 42 of the recessed channel 30 may only extend forward of the vertical portion 40 by one tenth of an inch or less and by as little as fifty (50) thousandths of an inch.

The front wall 32 of the recessed channel 30 may comprise a slot 44 for accessing the vertical portion 40 and horizontal portion 42 of the recessed channel 30. The slot 44 may be in the shape of an "L." The slot 44 may comprise a vertical segment 46, which is the vertical part of the "L," and an horizontal segment 48, which is the horizontal part of the "L." Generally, the shape of the slot 44 may correspond to or mirror the shape of the recessed channel 30 such that the vertical portion 40 and horizontal portion 42 of the recessed channel 30 are adjacent to the vertical segment 46 and horizontal segment 48 of the slot 44, respectively.

Figure 2B:
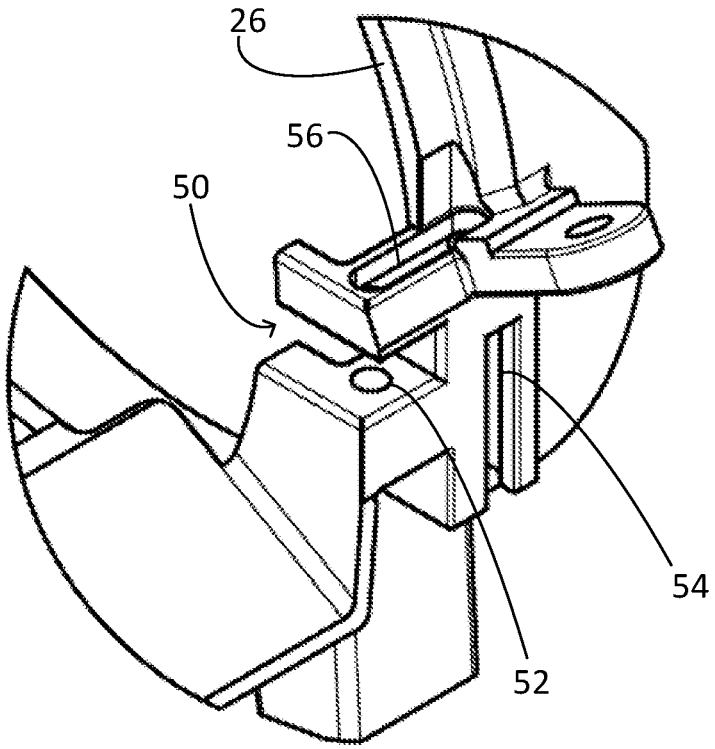
FIG. 2B is enlarged view of a portion of the rotor housing shown in Circle B of FIG. 2.

The rotor housing 10 may also be configured to receive and secure the guide bar 12 to the rotor housing 10 adjacent the front end 26 of the ammunition port 24. As shown in FIGS. 2 and 2B, the rotor housing 10 may comprise a guide bar slot 44 configured to receive the guide bar 12 adjacent the front end 26 of the ammunition port 24 and a lock pin pinhole 52 extending through the rotor housing 10 adjacent the guide bar slot 50 on one or both sides of the guide bar slot 50. The rotor housing 10 may further comprise an extractor pin channel 54 and/or an extractor pin pinhole 56. The extractor pin channel 54 may be disposed adjacent the extractor pin pinhole 56. The extractor pin pinhole 56 may be disposed between the rotor housing front 16 and the ammunition port front end 26 and/or forward of the guide bar slot 50 and lock pin pinhole 52. The extractor pin pinhole 56 may extend through the rotor housing 10. The extractor pin pinhole 56 may also extend parallel to and/or be aligned with the extractor pin channel 54. The extractor pin pinhole 56 may extend parallel to the lock pin pinhole 52. In some embodiments, the extractor pin pinhole 56 and lock pin pinhole 52 are the same hole.

Figure 3:
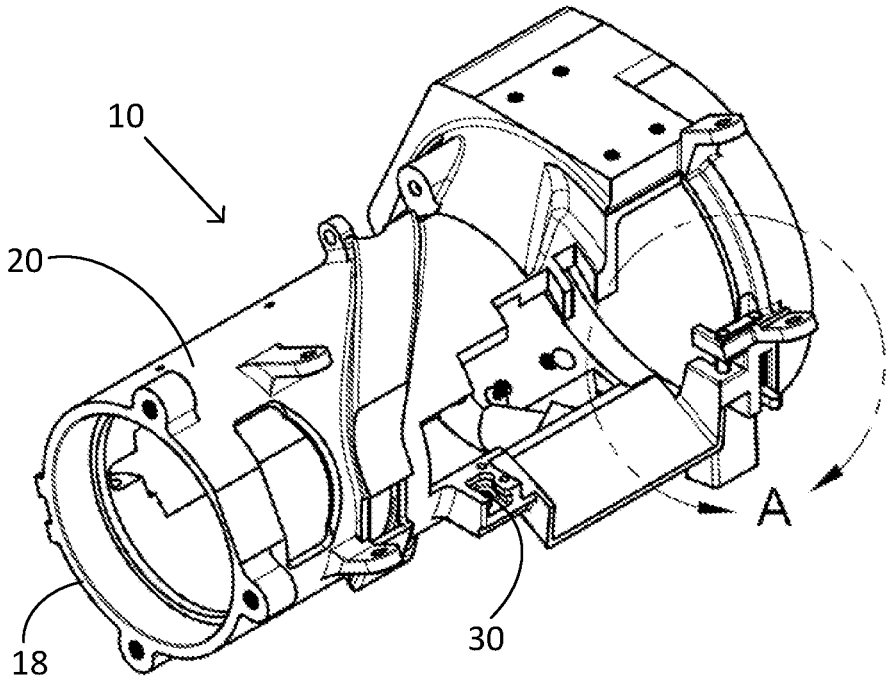
FIG. 3 is another bottom, side perspective view of the rotor housing of FIG. 1.
Figure 3A:
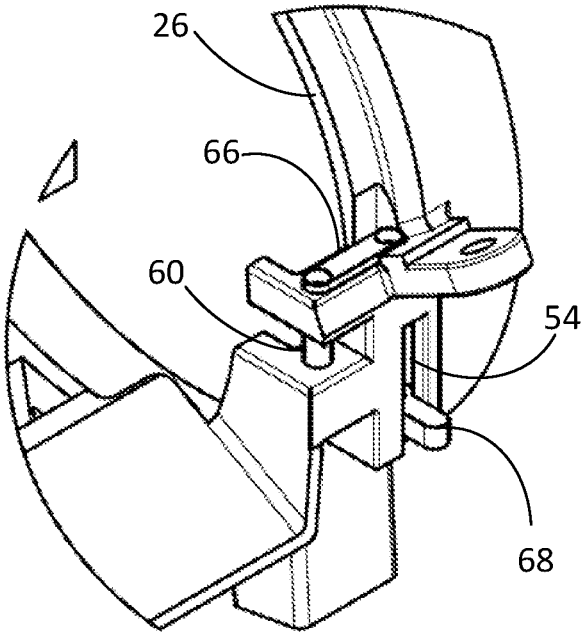
FIG. 3A is enlarged view of a portion of the rotor housing shown in Circle A of FIG. 3.

Referring to FIG. 3-3A, the rotor housing 10 may further comprise a lock pin assembly 58 for releasably securing the guide bar 12 to the rotor housing 10 adjacent the front end 26 of the ammunition port 24. The lock pin assembly 58 comprises a lock pin 60. The lock pin 60 is configured to insert through the lock pin pinhole 52 and to pass through the lock pin pinhole 52 and into the guide bar slot 50. In some embodiments, the lock pin assembly 58 may be spring loaded. In such embodiments, the lock pin assembly 58 may further comprise a spring 62. The spring 62 may bias the lock pin 60 through the lock pin pinhole 52 and into the guide bar slot 50 such that the default position of the lock pin 60 is for the lock pin 60 to be disposed in the guide bar slot 50.

In some embodiments, the lock pin assembly 58 may further comprise an extractor pin 64, a cross bar 66, and a push tab 68 for extracting the lock pin 60 from the guide bar slot 50. The extractor pin 64 may be disposed in and slidable through the extractor pin channel 54 and/or the extractor pin pinhole 56. The cross bar 66 may secure an end of the extractor pin 64 and to an end of the lock pin 60 such that the lock pin 60 moves in a synchronized fashion with the extractor pin 64 when the extractor pin 64 moves. The push tab 68 is connected to an end of the extractor pin 64 opposite the cross bar 66, which may be an end of the extractor pin 64 that is disposed in the extractor pin channel 54. The spring 62 may be disposed around or adjacent to the extractor pin 64 in the extractor pin channel 54 and between the push tab 68 and the rotor housing 10.

Figure 4:
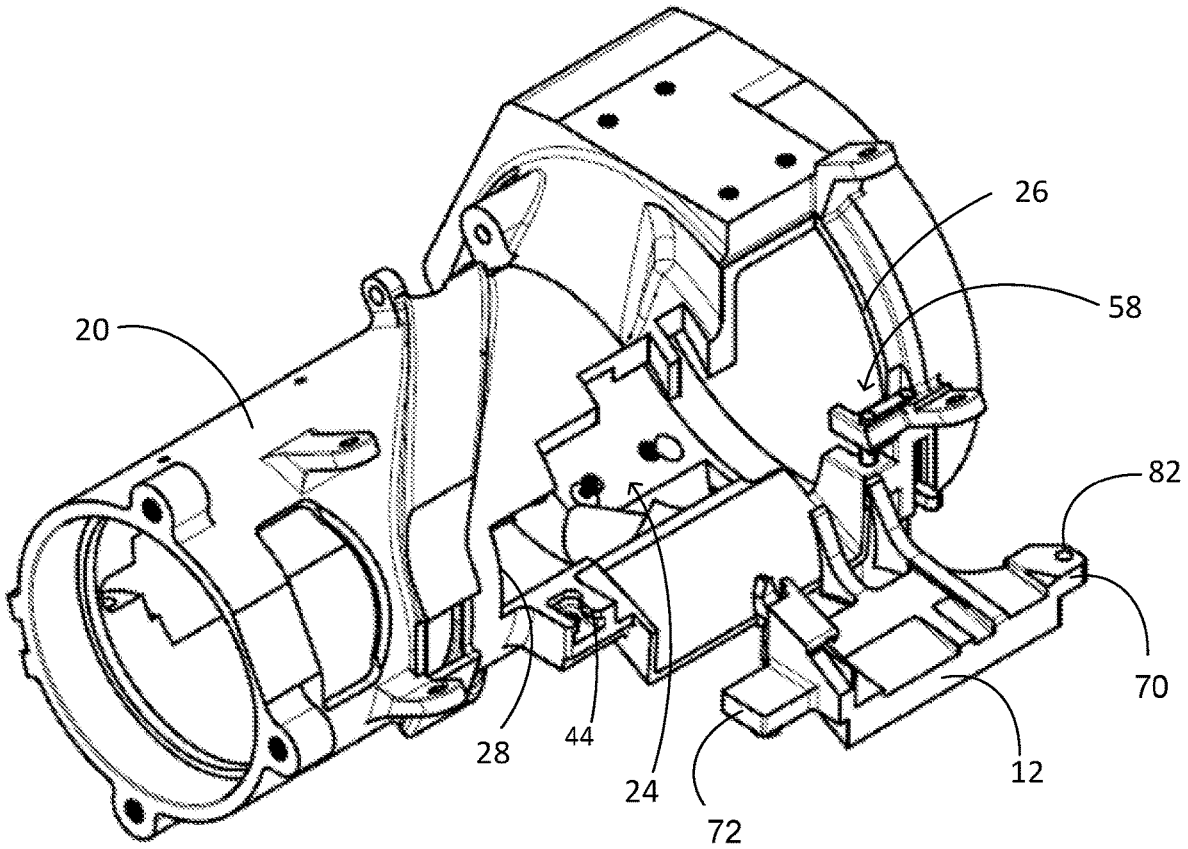
FIG. 4 is another bottom, side perspective view of the rotor housing of FIG. 1.
Figure 5:
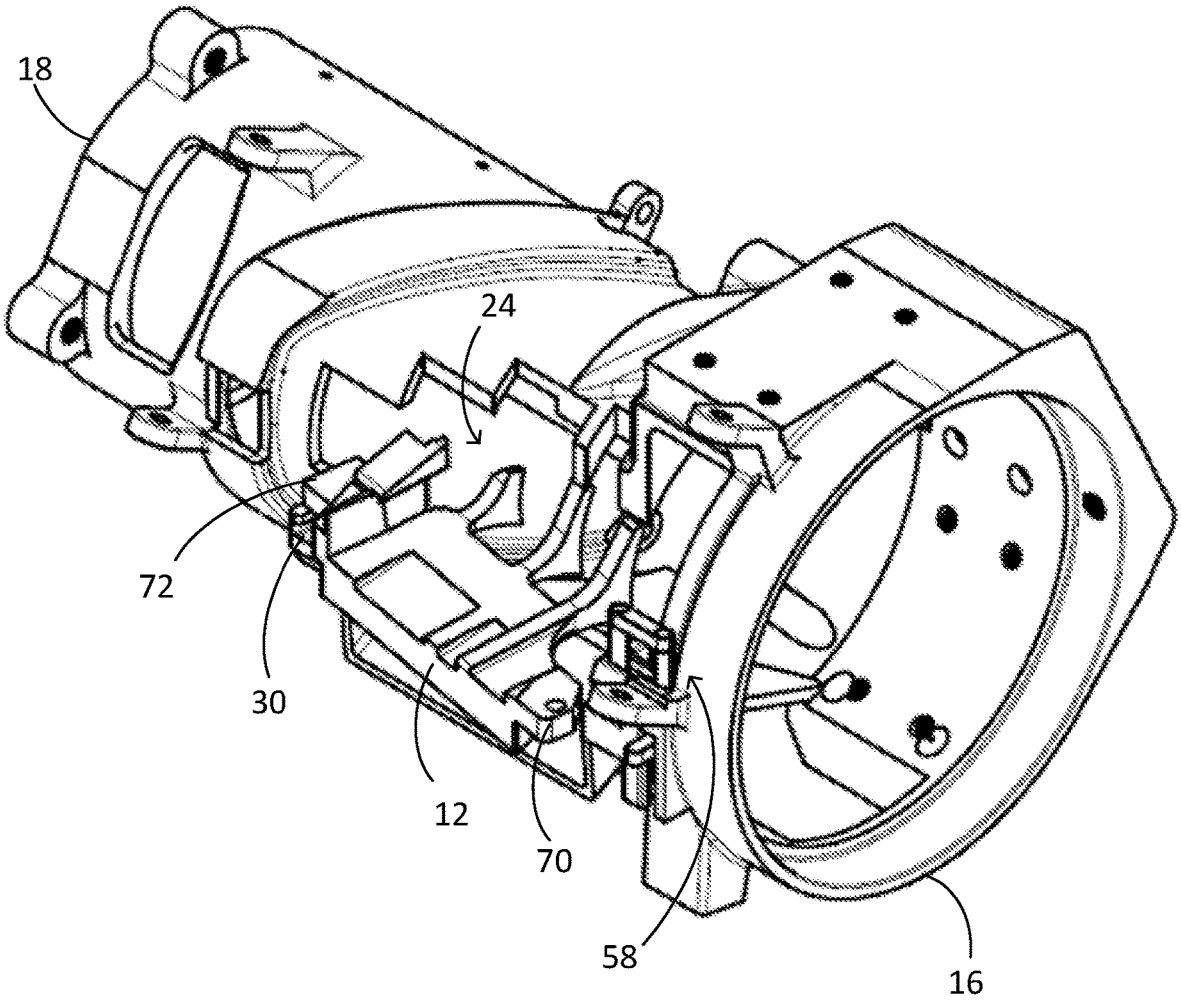
FIG. 5 is another bottom, side perspective view of the rotor housing of FIG. 1.

To operate the lock pin assembly 58, an operator may press on the push tab 68, which may compress the spring 62, if present, between the push tab 68 and the rotor housing 10 and move the extractor pin 64 though the extractor pin channel 54 and into the extractor pin pinhole 56. The movement of the extractor pin 64 may move the cross bar 66, which may in turn extract the lock pin 60 from the guide bar slot 50 through the lock pin pinhole 52. FIG. 5 shows the push tab 68 in a pressed position with the lock pin 60 extracted from the guide bar slot 50. When the operator releases the push tab 68, the spring 62 may exert a force on the push tab 68, which may draw the extractor pin 64 back through the extractor pin pinhole 56 and into the extractor pin channel 54. The movement of the extractor pin 64 may pull on the cross bar 66, which may in turn push the lock pin 60 back through the lock pin pinhole 52 and into the guide bar slot 50. FIGS. 3-4 shows the push tab 68 in a released position with the lock pin 60 extending into the guide bar slot 50.

FIGS. 7-10 shows a guide bar 12 of a minigun in accordance with the present disclosure. As ammunition is passed from the feeder delinker (not shown) into the rotor housing 10 during operation of the minigun, the guide bar 12 guides the ammunition onto the rotor 14. The guide bar 12 may have a front end 70, a rear end 72, and a plurality of other indentions 74 and protrusions 76 disposed on the guide bar 12 between the front end 70 and rear end 72. The guide bar 12 is configured with the indentions 74 and protrusions 76 to allow the guide bar 12 to operate cooperatively with the other moving parts of the minigun.

In some embodiments, the guide bar 12 may have a plurality of guide rails 78 for guiding ammunition into the rotor housing 10 and removing spent ammunition from the rotor housing 10. The guide rails 78 may be disposed between the guide bar front end 70 and guide bar rear end 72 and extend into the rotor housing 10 when the guide bar 12 is attached to the rotor housing 10. The guide rails 78 may also align with gaps 80 on the rotor 14 when the guide bar 12 is attached to the rotor housing 10 to facilitate the exchange of ammunition between the guide bar 12 and the rotor 14. Legacy guide bars have two guide rails. A guide bar 12 of the present disclosure may have three guide rails 78. The third guide rail 78 may be located nearer the guide bar front end 70 than the other two guide rails 78. Without being bound to any particular theory, the third guide rail 78 helps prevent malfunctions in the minigun when different types of ammunition are used. In particular, the third guide rail 78 may prevent plastic ammunition from failing to eject. When used with the M134 Minigun, plastic ammunition is frequently deformed by the forces acting on it from the guide bar 12 and the rotor 14. The plastic ammunition casings can become jammed in the guide bar 12 or rotor 14 and cause the minigun to malfunction. Operation of the minigun must then be stopped while the operator removes the guide bar 12 from the rotor housing 10 or uses tools to clear the jammed ammunition from the guide bar 12 and rotor 14. A guide bar 12 having three guide rails 78 helps ensure that spent ammunition casings properly exit the rotor housing and do not become jammed or otherwise cause the minigun to malfunction.

Referring to FIGS. 7-10, the guide bar front end 70 may comprise a pinhole 82 that may extend through the guide bar front end 70 and be configured to receive the lock pin 60. The guide bar front end 70 may be configured to be inserted into the guide bar slot 50. The guide bar rear end 72 may comprise a locking cam 76 for securing the guide bar rear end 72 to the rotor housing 10. The locking cam 84 may have a width 86 and a diameter 88 and may be configured to insert into the recessed channel 30. Typically, the width 86 of the locking cam 84 is less than the width 36 of the recessed channel 30 of the rotor housing 10 and the diameter 88 of the locking cam 84 is less than the length 38 of the recess channel 30 to allow the locking cam 84 to be inserted into the recessed channel 30. The guide bar rear end 72 may further comprise a shaft 90 connecting the locking cam 84 to the guide bar rear end 72. The shaft 90 may be disposed in and pass through the slot 44 when the locking cam 84 is inserted into the recessed channel 30.

Figure 6:
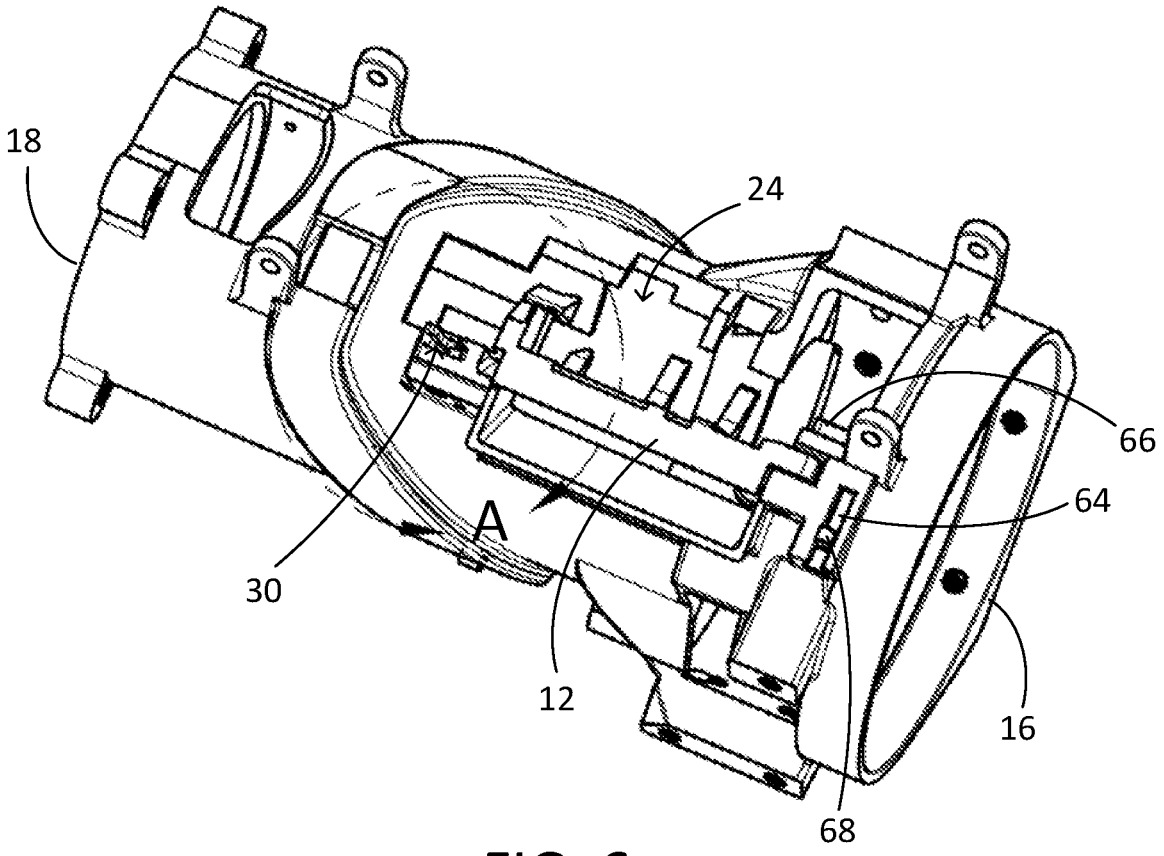
FIG. 6 is another bottom, side perspective view of the rotor housing of FIG. 1.
Figure 6A:
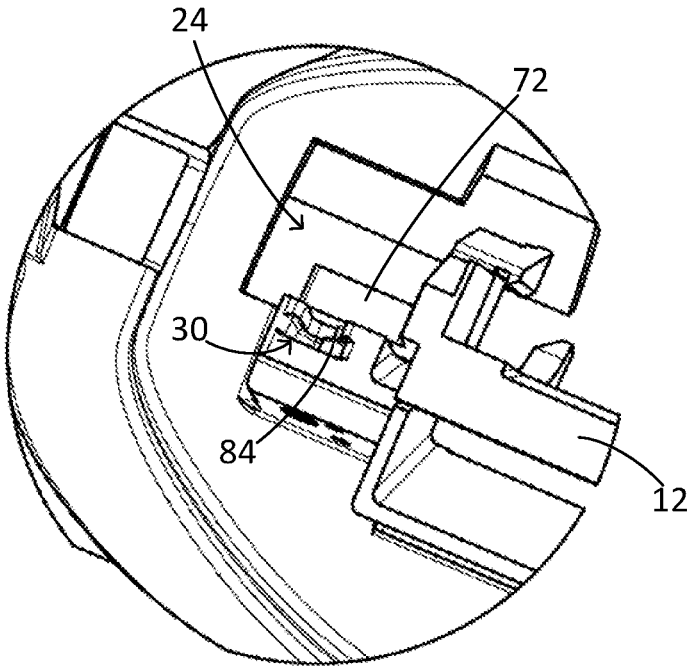
FIG. 6A is enlarged view of a portion of the rotor housing shown in Circle A of FIG. 6A.
Figure 7:
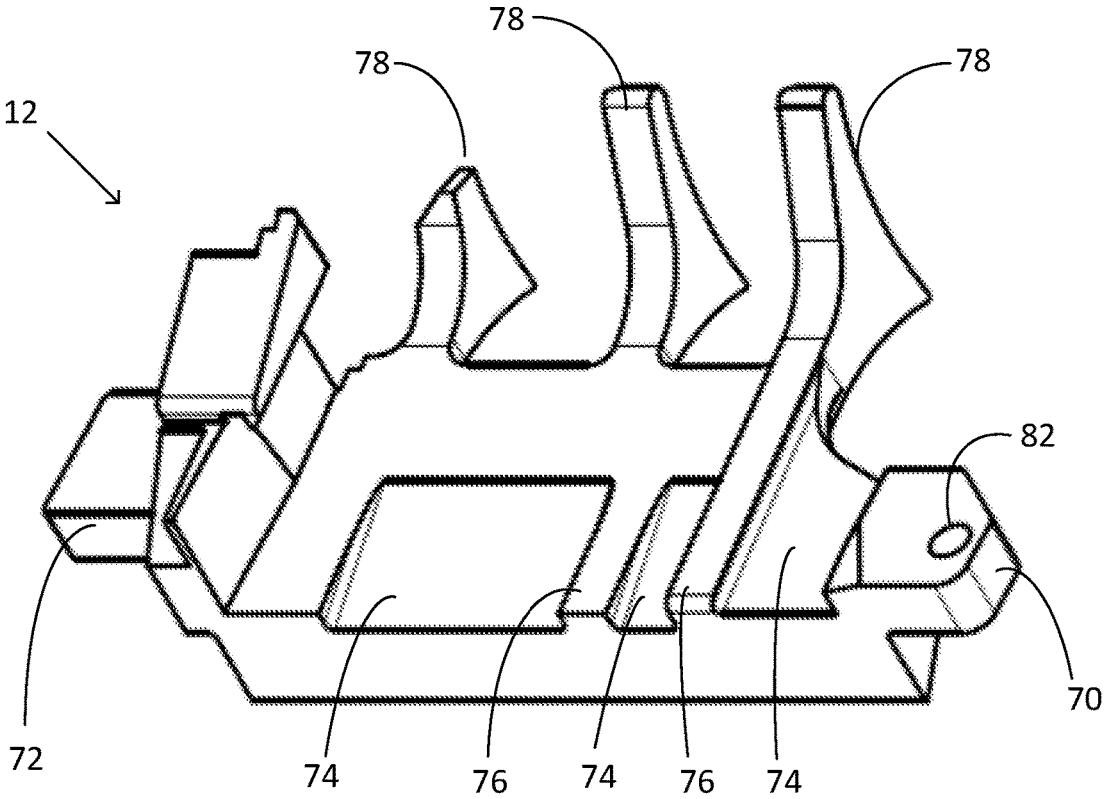
FIG. 7 is a bottom, side perspective view of a guide bar of a minigun rotor housing according to an exemplary embodiment of the present disclosure.
Figure 8:
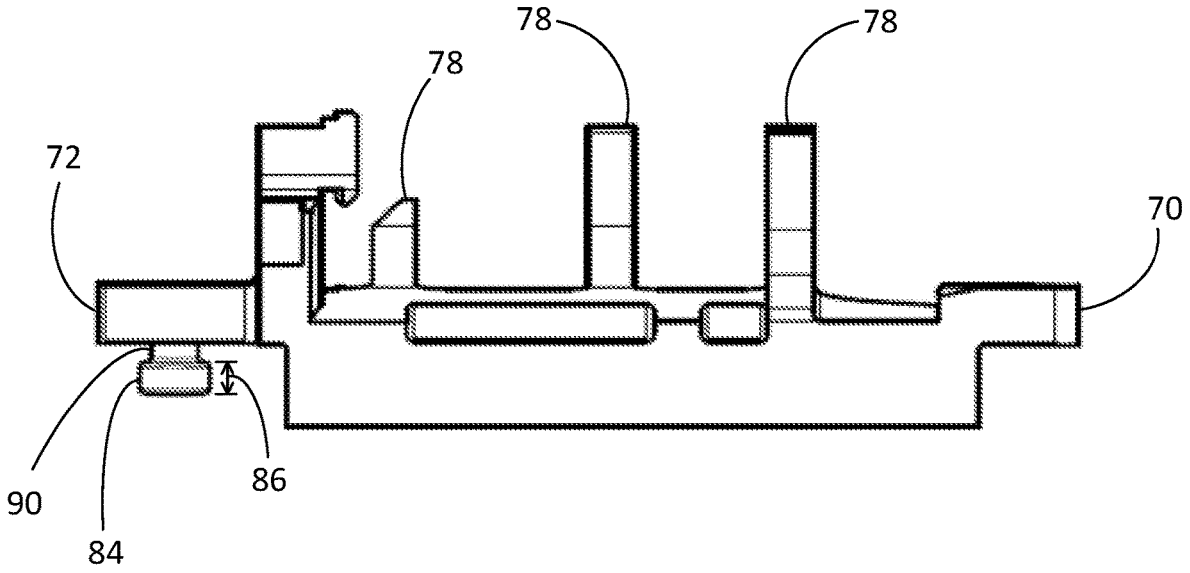
FIG. 8 is a bottom plan view of the guide bar of FIG. 7.
Figure 9:
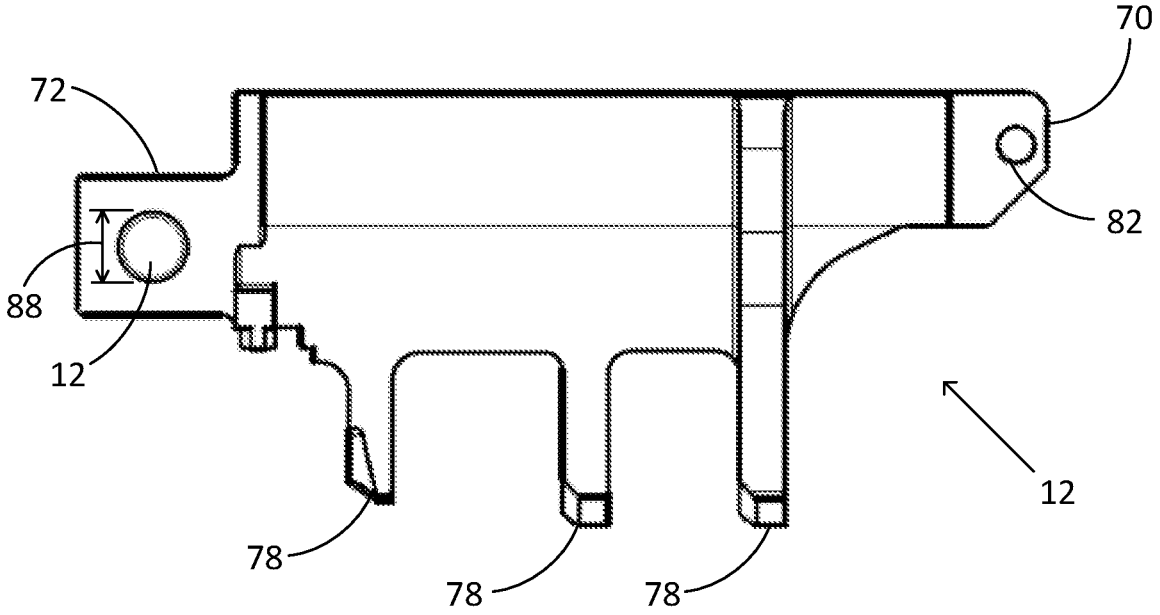
FIG. 9 is a side elevation view of the guide bar of FIG. 7.
Figure 10:
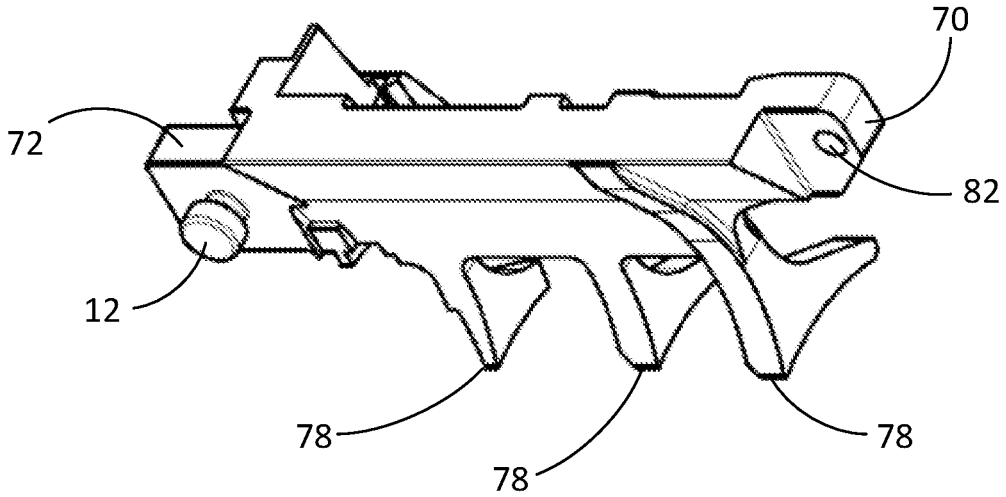
FIG. 10 is another bottom, side perspective view of the guide bar of FIG. 7.
Figure 11:
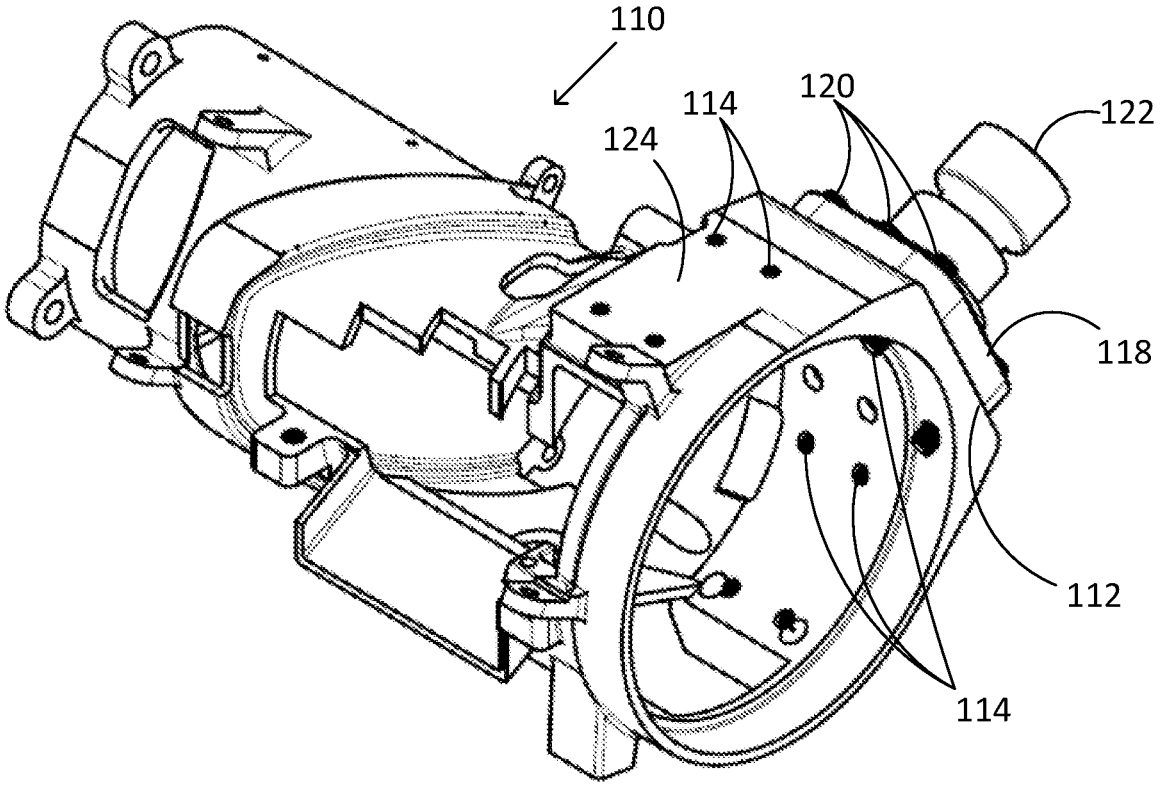
FIG. 11 is a bottom, side perspective view of a yokeless rotor housing of a minigun according to an exemplary embodiment of the present disclosure.
Figure 12:
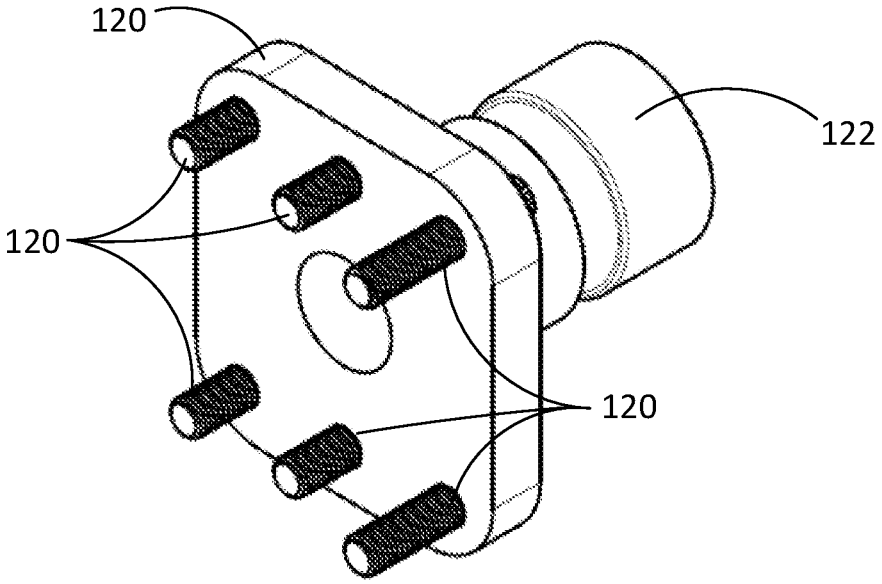
FIG. 12 is a bottom, side perspective view of the mounting plate of the rotor housing shown in FIG. 11.
Figure 13:
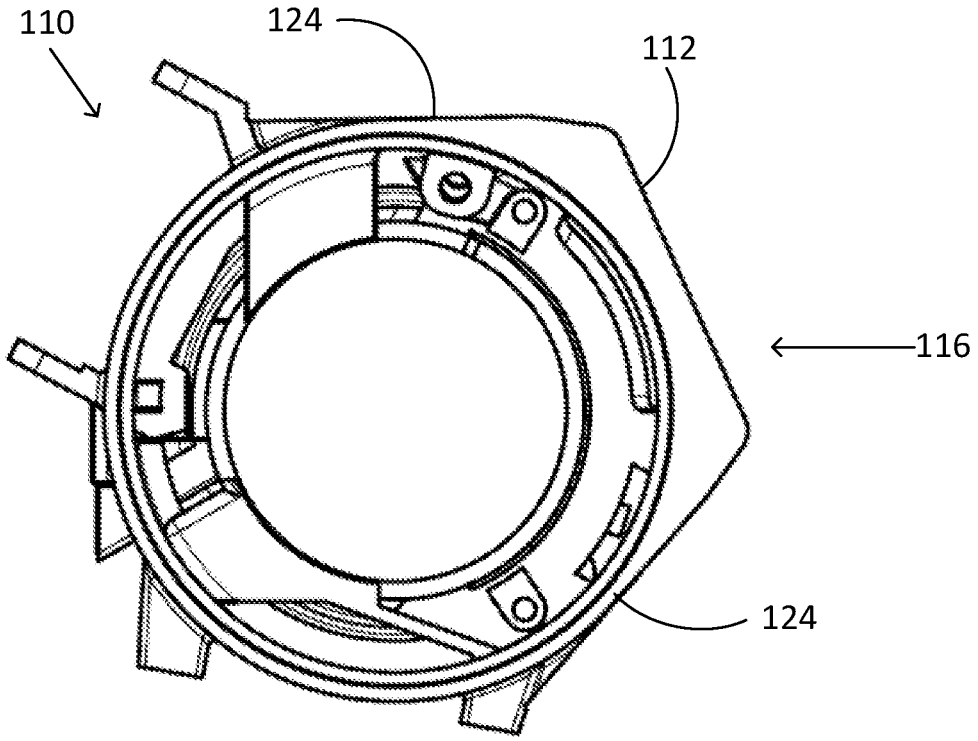
FIG. 13 is a front plan view of the rotor housing of FIG. 11.
Figure 14:
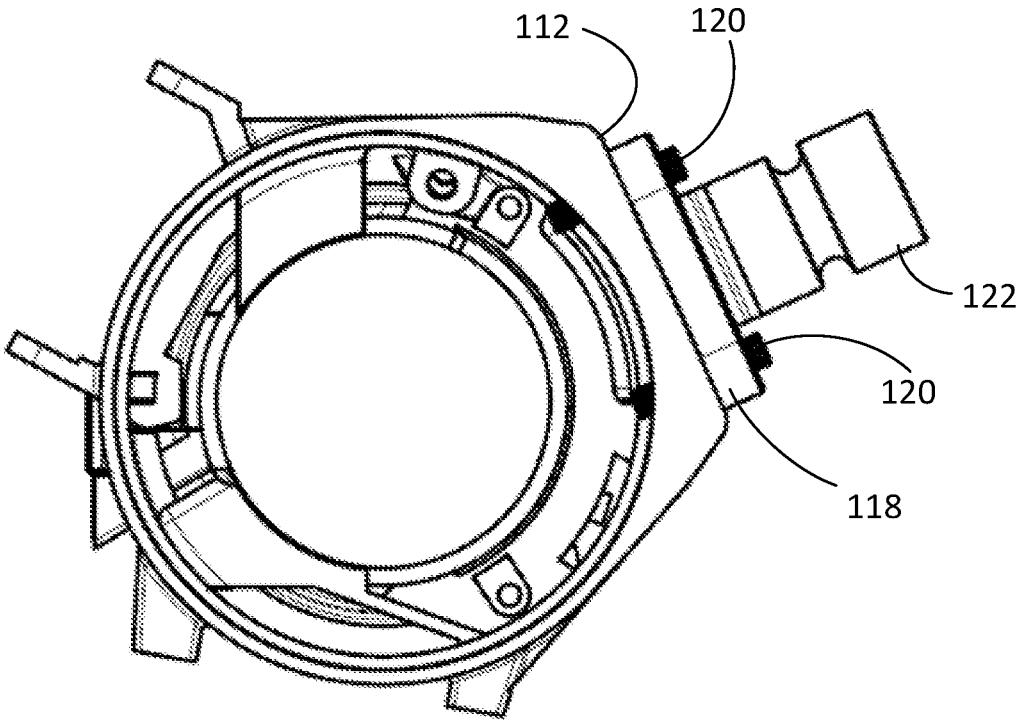
FIG. 14 is a front plan view of the rotor housing of FIG. 11.

To secure the guide bar 12 to the rotor housing 10, an operator may first insert the locking cam 84 through the vertical portion 40 of the recessed channel 30 to the horizontal portion 42 of the recessed channel 30. Once the locking cam 84 is in the horizontal portion 42 of the recessed channel 30, the operator may then move the locking cam 84 forward in the horizontal portion 42 of the recessed channel 30 as shown in FIG. 5-6A. As discussed above, the horizontal portion 42 of the recessed channel 30 may only extend forward of the vertical portion 40 by as little as fifty (50) thousandths of an inch, so the operator may only be able to move the locking cam 84 forward in the horizontal portion 42 of the recessed channel 30 by as little as fifty (50) thousandths of an inch. The operator may then use the lock pin assembly 58 to extract the lock pin 60 from the guide bar slot 50 as discussed above and shown in FIG. 5. The operator may then insert the guide bar front end 70 into the guide bar slot 50, align the pinhole 82 on the guide bar 12 with the lock pin pinhole 52 on the rotor housing 10, and insert the lock pin 60 through the guide bar pinhole 82 using the lock pin assembly 58 as shown in FIG. 6-6A.

The guide bar 12 may be configured such that the guide bar pinhole 82 aligns with the lock pin pinhole 52 or receives the lock pin 60 when the locking cam 84 is disposed forwardly in the horizontal portion 42 of the recessed channel 30. When the guide bar 12 is configured in this way, the locking cam 84 is prevented from moving rearwardly in the horizontal portion 42 of the recess channel 30 when the lock pin 60 is inserted through the lock pin pinhole 52 and the guide bar pinhole 82. Among other benefits, the L shape of the recessed channel 30 may prevent the locking cam 84 from being removed from the recessed channel 30 when the locking cam 84 is disposed forwardly in the horizontal portion 42 of the recessed chamber 30. Thus, the guide bar rear end 72 may be secured to the rotor housing 10 when the lock pin 60 is inserted through the lock pin pinhole 52 and the guide bar pinhole 82 because the lock pin 60 prevents the guide bar 12 from moving rearwardly and, correspondingly, prevents the locking cam 84 from moving rearwardly and exiting the recessed channel 30.

To detach the guide bar 12 from the rotor housing 10, an operator may use the lock pin assembly 58 to release the guide bar front end 70 by removing the lock pin 60 from the guide bar slot 50 and guide bar pinhole 82 as described above. The operator may then remove the locking cam 84 from the recessed channel 30 by moving the guide bar 12 and locking cam 84 rearwardly and sliding the locking cam 84 out of the recessed channel through the vertical portion 40 of the recessed channel 30. The guide bar 12 may then be removed from the rotor housing 10 to allow the operator to access the ammunition port 24 to conduct maintenance or correct malfunctions.

In some embodiments, the rotor housing 10 is also compatible with legacy guide bars 92. The legacy guide bar 92 may comprise a front end 94 comprising a pinhole 96 and a rear end 98 comprising a bolt hole 100. In embodiments of the rotor housing 10 that are compatible with the legacy guide bar 92, the rotor housing 10 may comprise a bolt hole 102 in the rear wall 34 of the recessed channel 30. The bolt hole 102 may be configured with standard ¼-28 threads to accept the legacy bolt (not shown) that secures the legacy guide bar rear end 98 to the rotor housing 10. In some embodiments of the rotor housing 10 that are compatible with the legacy guide bar 92, the lock pin pinhole 52 of the rotor housing 10 may be configured to accept a legacy lock pin (not shown) or the lock pin assembly 58 and lock pin 60 may be compatible with the legacy guide bar 92. The rotor housing 10 may also be configured such that the lock pin pinhole 52 and the bolt hole 102 of the rotor housing 10 may simultaneously align with the legacy guide bar pinhole 96 and the bolt hole 100 on the legacy guide bar 92, respectively.

The components of the rotor housing 10, lock pin assembly 58, and guide bar 12 may be made from any type of metal. A person having ordinary skill in the art would know to construct particular components from certain metals or metal alloys to give those components desired characteristics. For example, the lock pin 60 may be made of 304 or 316 stainless steel to have characteristics such as high strength and corrosion resistance. As another example, the guide bar 12 may be cast from 17-4 PH stainless steel, Inconel 625, or Inconel 718 for a high strength and corrosion resistant guide bar. In another embodiment, some components may be cast in titanium to produce a high strength, lightweight component. The guide bar 12 may also be manufactured using casting or additive manufacturing techniques. For example, prototypes of the guide bar 12 have been made from Inconel 718 using additive manufacturing.

In another aspect of the present disclosure, FIGS. 11-14 depict a yokeless rotor housing 110 for a minigun. The yokeless rotor housing 110 comprises a flat surface 112 having one or more bolt holes 114 on the flat surface 112. The flat surface 112 and bolt holes 114 form a pad 116 for attaching a mounting plate 118. The mounting plate 118 has bolts 120 aligned with the bolt holes 114 on the pad 116 of the rotor housing 110, such that the mounting plate 118 may be secured to the pad 116 and securing the mounting plate 118 in place with nuts. The mounting plate 118 has a connector 122 designed to interface with the connecting unit of a stand or platform (not shown) for holding the minigun.

The pad 116 and/or mounting plate 118 may be structurally reinforced (e.g., by providing thicker metal or other supports) to prevent twisting or bending of the rotor housing 110 once connected to the stand or platform (not shown). In some embodiments, such as that depicted in FIGS. 11-14, the pad 116 has six bolt holes 114 for receiving six bolts 120 of the mounting plate 118. A six-bolt mount such shown in FIGS. 11-14 allows the rotor housing 110 to both receive a legacy yoke if necessary and also permits the use of a simple mounting plate (as shown) that may be designed to retrofit and work with legacy mounting and stand or platform systems.

In some embodiments, the bolts 120 may be placed on the pad 116, while the mounting plate 118 has bolt holes 114. Alternatively, the mounting plate 118 may be integrally formed with the rotor housing 110, such that the connector 122 for interfacing with the stand or platform is integrally formed with the housing 110 without the need for a separate mounting plate 118. The rotor housing 110 may also be provided with one or more accessory pads 124. Accessory pads 124 can be used to mount accessories such as a gun sight on the rotor housing 110. Accessory pads 124 may also have bolt holes 114 similar to those shown on the primary pad 116.

The rotors described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the rotors in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention (s) set forth herein.

What is claimed is:

1. A guide bar for attaching and detaching to a rotor housing of a minigun having barrels at a front end, a lock pin proximate to the front end of the rotor housing, and a recessed channel distal to the front end of the rotor housing, the guide bar comprising:

a guide bar body extending along a longitudinal axis from a guide bar front end to a guide bar rear end, with a cartridge guiding portion therebetween;

the guide bar rear end including a transversely extending shaft having a locking cam at one end thereof, the locking cam configured to be received in the recessed channel; and the guide bar front end including a pinhole configured to receive the lock pin;

wherein the guide bar is secured to the rotor housing when the locking cam is received in the recessed channel and the lock pin is received in the pinhole.

2. The guide bar of claim 1, further comprising three guide rails disposed between the guide bar front end and the guide bar rear end.

* * * * *